US005240433A

United States Patent [19]

Kato

[11] Patent Number: 5,240,433

[45] Date of Patent: Aug. 31, 1993

[54] WATERPROOF ELECTRIC CONNECTOR

[75] Inventor: Tetsuo Kato, Shizuoka, Japan

[73] Assignee: Yazaki Corporation, Japan

[21] Appl. No.: 922,739

[22] Filed: Jul. 31, 1992

[30] Foreign Application Priority Data

Aug. 13, 1991 [JP] Japan ..... 3-063949[U]

[51] Int. Cl.[5] ..... H01R 13/40

[52] U.S. Cl. ..... 439/587; 439/279; 439/752

[58] Field of Search ..... 439/519, 521, 523, 587, 439/589, 752, 279

[56] References Cited

U.S. PATENT DOCUMENTS 4,611,872 9/1986 Ito et al. ..... 439/587
4,735,581 4/1988 Endo et al. ..... 439/587
4,895,533 1/1990 Yagi et al. ..... 439/587
5,145,410 9/1992 Maejima et al. ..... 439/587

*Primary Examiner*—Paula A. Bradley
*Attorney, Agent, or Firm*—Venable, Baetjer, Howard & Civiletti

[57] ABSTRACT

A waterproof electric connector is provided which renders an inserting operation easy by incorporating waterproof plugs into a connector housing. It includes a connector housing having a plurality of terminal-accommodating cylinders and a waterproof plug retaining member having terminal-inserting openings corresponding to the terminal-accommodating cylinders. Waterproof plugs are engaged with and fixed by the waterproof plug retaining member. Terminals connected to electric wires are inserted into the waterproof plugs through the terminal-inserting openings. The waterproof plugs are mated tightly with the inner surfaces of the terminal-accommodating cylinders.

8 Claims, 3 Drawing Sheets

WATERPROOF ELECTRIC CONNECTOR

BACKGROUND OF THE INVENTION

1. Field of the Invention

The present invention relates to a waterproof electric connector for use in an environment that is exposed to water, and particularly, to waterdrops.

2. Description of the Related Art

To make electric connectors waterproof, not only must connector housings themselves be watertight, but also the gaps between the housings and electric wires with terminals to be inserted into the housings. To this end, conventionally, the electric wires are inserted first into waterproof plugs, each having small and large diameter portions, and then into terminals, each having an electric contact member at its front end, an electric wire conductive member at the center and an electric wire fastening member with a waterproof plug at its rear end. The electric wires are fixed by the electric wire conductive members, whereas the small diameter portions of the waterproof plugs are fixed by the electric wire fastening members. The terminals to which the waterproof plugs and electric wires are secured are inserted into the housing. (Refer to Japanese Utility Model Laid-Open No. 60-71082.)

Fine electric wires are likely to bend when they are inserted into the waterproof plugs during the operation of inserting such terminals into the housing. This consumes time because it is difficult to crimp the electric wires to the terminals after they have been inserted into the waterproof plugs.

The present invention solves the above problems, and the object thereof is to provide a highly reliable waterproof electric connector which renders the inserting operation easy and is capable of retaining waterproof plugs by incorporating a waterproof plug retaining member into a connector housing and by inserting terminals connected to electric wires into the waterproof plugs.

SUMMARY OF THE INVENTION

To achieve the above object, this invention provides a waterproof electric connector comprising a connector housing having a plurality of terminal-accommodating cylinders and a waterproof plug retaining member having terminal-inserting openings corresponding to the terminal-accommodating cylinders. The structure of the waterproof plug retaining member is such that a waterproof plug engages and mates with the inner periphery of each terminal-inserting opening. Each terminal-accommodating cylinder has an inner surface with which each waterproof plug mates.

In accordance with the structure described above, the waterproof plugs engaged with and held by the inside of the waterproof plug retaining member are tightly fitted together with the inner surfaces of the terminal-accommodating cylinders. Thus, the terminal-accommodating cylinders into which terminals are inserted are made watertight. It is therefore unnecessary to attach waterproof plugs to terminals connected to electric wires. A watertight electrical connection can be made by the same operation as with standard non-waterproof plugs.

The preferred embodiment of this invention will be described with reference to the accompanying drawings.

DESCRIPTION OF THE PREFERRED EMBODIMENT

Figure 1:
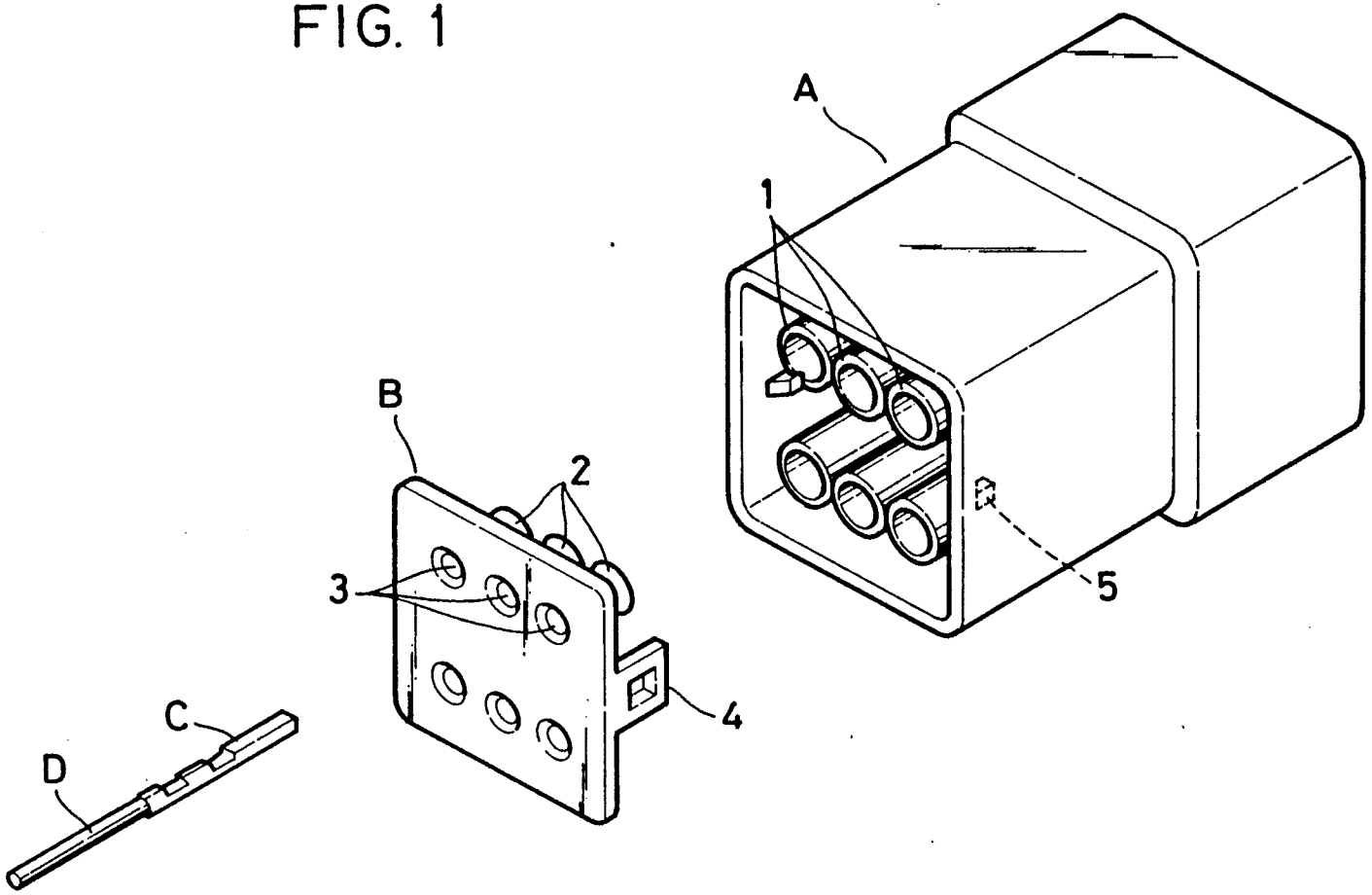
FIG. 1 is an exploded perspective view showing a connector housing, a waterproof plug retaining member and a terminal connected to electric wire, all of which are preassembled and constitute the waterproof electric connector of this invention.

Referring to FIG. 1, a waterproof electric connector of this invention comprises a connector housing A and a plate-like waterproof plug retaining member B attached to the back of the housing A. The connector housing A has six cylinders 1 for accommodating terminals. Attaching projections 5 are formed on side walls of the connector housing A. The waterproof plug retaining member B has six openings 3 for inserting terminals so as to correspond to the cylinders 1. Waterproof plugs 2 engage around the terminal-inserting openings 3 facing the connector housing A. Engaging lock pieces 4 are formed on both sides of the waterproof plug retaining member B, which pieces engage with the attaching projections 5 of the connector housing A. Thereby, the connector housing A and the waterproof plug retaining member B are mated and fixed. A terminal C connected to electric wire D is inserted into the connector housing A through the terminal-inserting opening 3. It is a standard terminal for non-waterproof purposes.

Figure 2:
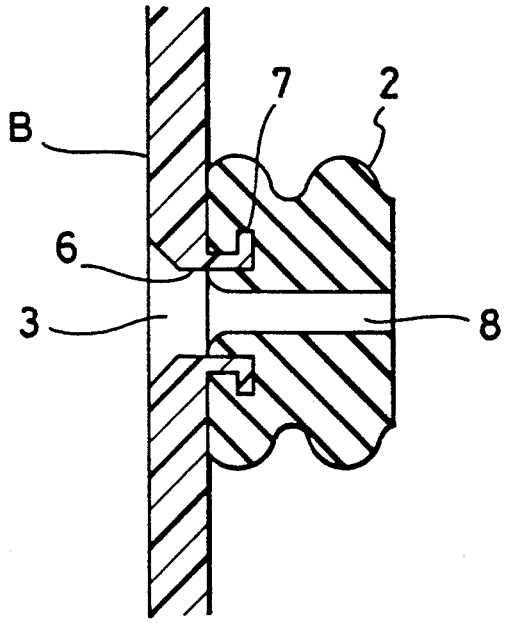
FIG. 2 is a partial sectional view of the waterproof plug retaining member shown in FIG. 1.
Figure 3:
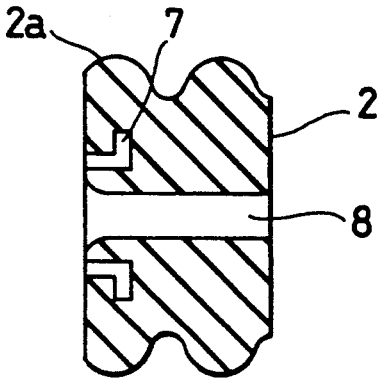
FIG. 3 is a sectional view of a waterproof plug shown in FIG. 2.

With reference to FIG. 2, a peripheral engaging projection 6 is formed around each terminal-inserting opening 3 in the waterproof plug retaining member B facing the connector housing A. A recess 7 for engaging purposes is formed in each waterproof plug 2 to attach to the waterproof plug retaining member B so that it corresponds to each projection 6. Each projection 6 engages with each recess 7, and thereby the waterproof plug retaining member B fixes each waterproof plug 2. As shown in FIG. 3, each waterproof plug 2 is made of a flexible and elastic material, such as rubber, and formed into a cylinder. The cross section of the outer periphery 2*a* of each waterproof plug 2 has the shape of two convexly-rounded projections. A hole 8 for inserting the terminal is formed at the center of each waterproof plug 2. The recess 7 for engaging purposes is formed in that surface of each waterproof plug 2 which contacts the waterproof plug retaining member B. The outside diameter of each waterproof plug 2 is slightly larger than the inside diameter of each terminal-accommodating cylinder 1 so that the cylinder 1 and plug 2 are tightly fitted when they are mated.

Figure 4:
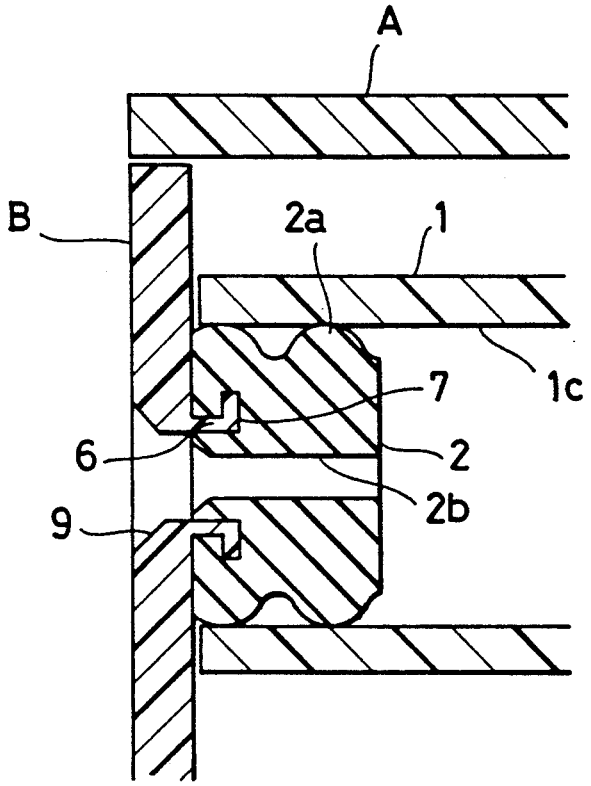
FIG. 4 is a partial sectional view showing the connector housing and waterproof plug retaining member when both components are engaged with each other.

Each waterproof plug 2 is mated with the inner wall 1*c* of each terminal-accommodating cylinder 1 as shown in FIG. 4, in which the connector housing A is engaged with the waterproof plug retaining member B. The outer periphery 2*a* of each waterproof plug 2 is tightly fitted together with the inner wall 1*c*, and each terminal C is inserted into each waterproof plug 2 so that it is tightly fitted together with the inner peripheral surface 2*b* of each waterproof plug 2. The above structure renders the inside of each terminal-accommodating cylinder 1 watertight. The outer periphery of each terminal-inserting opening 3 is tapered to provide easy insertion of each terminal C.

According to this invention, the terminals C are inserted into the waterproof plugs 2 engaging with the waterproof plug retaining member B, and the waterproof plugs 2 are mated with the inner surfaces 1*a* of the terminal-accommodating cylinders 1. Therefore, the insides of the terminal-accommodating cylinders 1 in the connector housing A can be watertight. It is unnecessary to attach waterproof plugs to terminals connected to electric wires. The terminals can be inserted into the waterproof plugs in the same manner as with standard non-waterproof terminals. A highly reliable waterproof electric connector can thus be realized which improves working efficiency and reduces the rate of failure.

What is claimed is:

1. A waterproof connector comprising:

a connector housing having a plurality of terminal-accommodating cylinders and a plurality of waterproof plugs that are mated with inner surfaces of respective said terminal-accommodating cylinders; and a waterproof plug retaining member capable of attaching to said connector housing, and having terminal inserting openings which correspond to said terminal-accommodating cylinders, said waterproof plugs being engaged with and retained by respective peripheral edges provided on each of said terminal-inserting openings, said peripheral edges facing said connector housing.

2. A waterproof connector comprising:

a connector housing having at least one terminal-accommodating cylinder;

at least one waterproof plug capable of mating with said at least one terminal-accomodating cylinder;

a plate capable of attaching to said connector housing, said plate having at least one terminal-inserting opening which corresponds to said at least one terminal-accommodating cylinder, said at least one terminal-inserting opening having a peripheral edge which engages and retains said at least one waterproof plug, said peripheral edge facing said connector housing.

3. A waterproof connector according to claim 2, wherein an outer periphery of said at least one terminal-inserting opening in said plate is gradually widened in an insertion direction.

4. A waterproof connector according to claim 2, further comprising:

at least one terminal to be inserted through said at least one terminal-inserting opening in said plate, through said at least one waterproof plug retained by said peripheral edge, and into said at least one terminal-accommodating cylinder in said connector housing.

5. A waterproof connector according to claim 2, wherein said at least one waterproof plug comprises a flexible and elastic cylindrical member having a terminal-inserting hole at the center thereof and a cross-sectional shape of convexly-rounded projections.

6. A waterproof connector according to claim 5, wherein the outside diameter of said at least one waterproof plug is slightly larger than the inside diameter of said at least one terminal-accommodating cylinder in said connector housing.

7. A waterproof connector comprising:

a connector housing having a plurality of terminal-accommodating cylinders;

waterproof plugs capable of mating with said terminal-accommodating cylinders; and a plate capable of attaching to said connector housing, said plate having terminal-inserting openings which correspond to said terminal-accommodating cylinders, and members for retaining said waterproof plugs around respective peripheries of said terminal-inserting openings said peripheries facing said connector housing;

wherein said members of said plate comprise projections formed around respective said peripheries of said terminal-inserting openings, each of said waterproof plugs being provided with a recess that corresponds to a respective said projection and is formed in a surface of the waterproof plug which is in contact with said plate.

8. A waterproof connector comprising:

a connector housing having a plurality of terminal-accommodating cylinders;

waterproof plugs capable of mating with said terminal-accommodating cylinders; and a plate capable of attaching to said connector housing, said plate having terminal-inserting openings which correspond to said terminal-accommodating cylinders, and members for retaining said waterproof plugs around respective peripheries of said terminal-inserting openings, said peripheries facing said connector housing;

wherein an outer periphery of each of said terminal-inserting openings in said plate is gradually widened in an insertion direction.

* * * * *